US005890712A

United States Patent [19]

Phillips et al.

[11] Patent Number: 5,890,712

[45] Date of Patent: Apr. 6, 1999

[54] DOCUMENT FEEDER TRAY

[75] Inventors: Robert W. Phillips, Waterloo; Kenneth S. Seymour, Conestogo, both of Canada

[73] Assignee: NCR Corporation, Dayton, Ohio

[21] Appl. No.: 837,258

[22] Filed: Apr. 10, 1997

[51] Int. Cl.[6] ..... B65H 1/26

[52] U.S. Cl. ..... 271/157; 271/160

[58] Field of Search ..... 271/160, 149, 271/157, 147

[56] References Cited

FOREIGN PATENT DOCUMENTS 2037261 7/1980 United Kingdom ..... 271/160

*Primary Examiner*—David H. Bollinger
*Attorney, Agent, or Firm*—Michael Chan

[57] ABSTRACT

A stack of documents to be fed to a document feeding mechanism can be placed on a horizontal surface. A plate is movable relative to the horizontal surface and advances the stack of documents along the horizontal surface towards the document feeding mechanism as the plate moves relative to the horizontal surface. A body is movable between different positions and, when moved between different positions, provides a variable force which acts on the stack of documents as the documents are being fed to the document feeding mechanism. The position of the body depends upon the position of the plate relative to the horizontal surface. The body is coupled to the plate in a manner to allow the body to move between different positions to provide the variable force which acts on the stack of documents while the plate is advancing the stack of documents along the horizontal surface towards the document feeding mechanism.

6 Claims, 13 Drawing Sheets

DOCUMENT FEEDER TRAY

BACKGROUND OF THE INVENTION

The present invention relates to document feeding along a document feed path of a document processing system, and is particularly directed to a document feeder tray for use in a document processing system such as a check processing system.

Different types of document feeder trays are known. A known type of document feeder tray is of the inclined type in which a stack of documents to be fed to a document feeding mechanism is placed on an inclined surface. The document feeding mechanism processes the stack of documents by picking the documents one-by-one from the lower end position of the stack of documents. Typically, a weight resting on the stack of documents rolls or slides along the inclined surface advances the stack of documents towards the document feeding mechanism. A disadvantage in using a document feeder tray of the inclined type is that the weight of the stack of documents varies with the size of the stack. As the documents are being fed, the size of the stack decreases. Accordingly, the weight of the stack decreases as the documents are being fed.

Another known type of document feeder tray is of the horizontal type in which a stack of documents to be fed to a document feeding mechanism is placed on a horizontal surface. The document feeding mechanism processes the stack of documents by picking the documents one-by-one from one end of the stack of documents. Typically, a spring-biased plate is disposed at the other end of the stack of documents to advance the stack of documents towards the document feeding mechanism. A disadvantage in using an apparatus of the horizontal type having a spring-biased plate is that the spring characteristics change over time due to normal wear and tear of the spring.

SUMMARY OF THE INVENTION

In accordance with one aspect of the present invention, a document feeder tray is provided for use in a document processing system having a document feeding mechanism. The document feeder tray comprises surface means defining a horizontal surface on which a stack of documents to be fed to the document feeding mechanism can be placed. A plate is movable relative to the horizontal surface and is provided for advancing the stack of documents along the horizontal surface towards the document feeding mechanism as the plate moves relative to the horizontal surface. A body is movable between different positions and is provided for, when moved between different positions, providing a variable force which acts on the stack of documents as the documents are being fed to the document feeding mechanism. The position of the body depends upon the position of the plate relative to the horizontal surface. Means is provided for coupling the body to the plate to allow the body to move between different positions to provide the variable force which acts on the stack of documents while the plate is advancing the stack of documents along the horizontal surface towards the document feeding mechanism.

Preferably, the body includes a longitudinally extending member having one end portion which is pivotably connected to a frame part of the document processing system and an opposite end portion which is a free end portion. The coupling means includes a cable having one end connected to the free end portion of the longitudinally extending member and the other end connected to the plate. The coupling means includes a DC motor and a capstan drivingly connected to the DC motor and around which the cable is wrapped. The coupling means includes a diode connected to the DC motor such that the DC motor is shorted to itself to provide a braking effect when the plate is moving along the horizontal surface towards the document feeding mechanism at a speed greater than a predetermined speed.

In accordance with another aspect of the present invention, a document processing system comprises a document feeding mechanism. Surface means defines a horizontal surface on which a stack of documents to be fed to the document feeding mechanism can be placed. A plate is movable relative to the horizontal surface and is provided for advancing the stack of documents along the horizontal surface towards the document feeding mechanism as the plate moves relative to the horizontal surface. A body is movable between different positions and is provided for, when moved between different positions, providing a variable force which acts on the stack of documents as the documents are being fed to the document feeding mechanism. The position of the body depends upon the position of the plate relative to the horizontal surface. Means is provided for coupling the body to the plate to allow the body to move between different positions to provide the variable force which acts on the stack of documents while the plate is advancing the stack of documents along the horizontal surface towards the document feeding mechanism.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
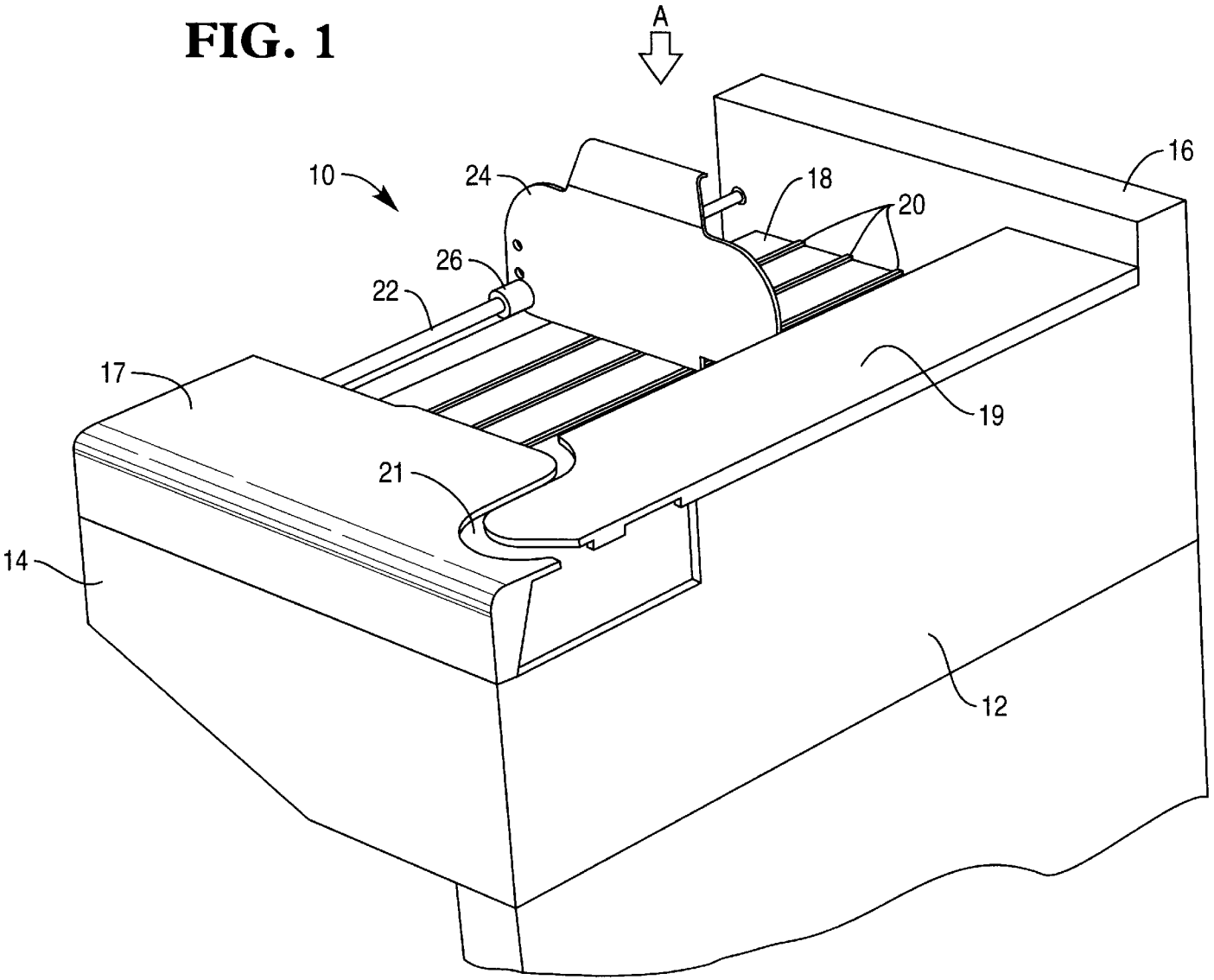
FIG. 1 is a perspective view of a document processing system embodying a document feeder tray constructed in accordance with the present invention.
Figure 4:
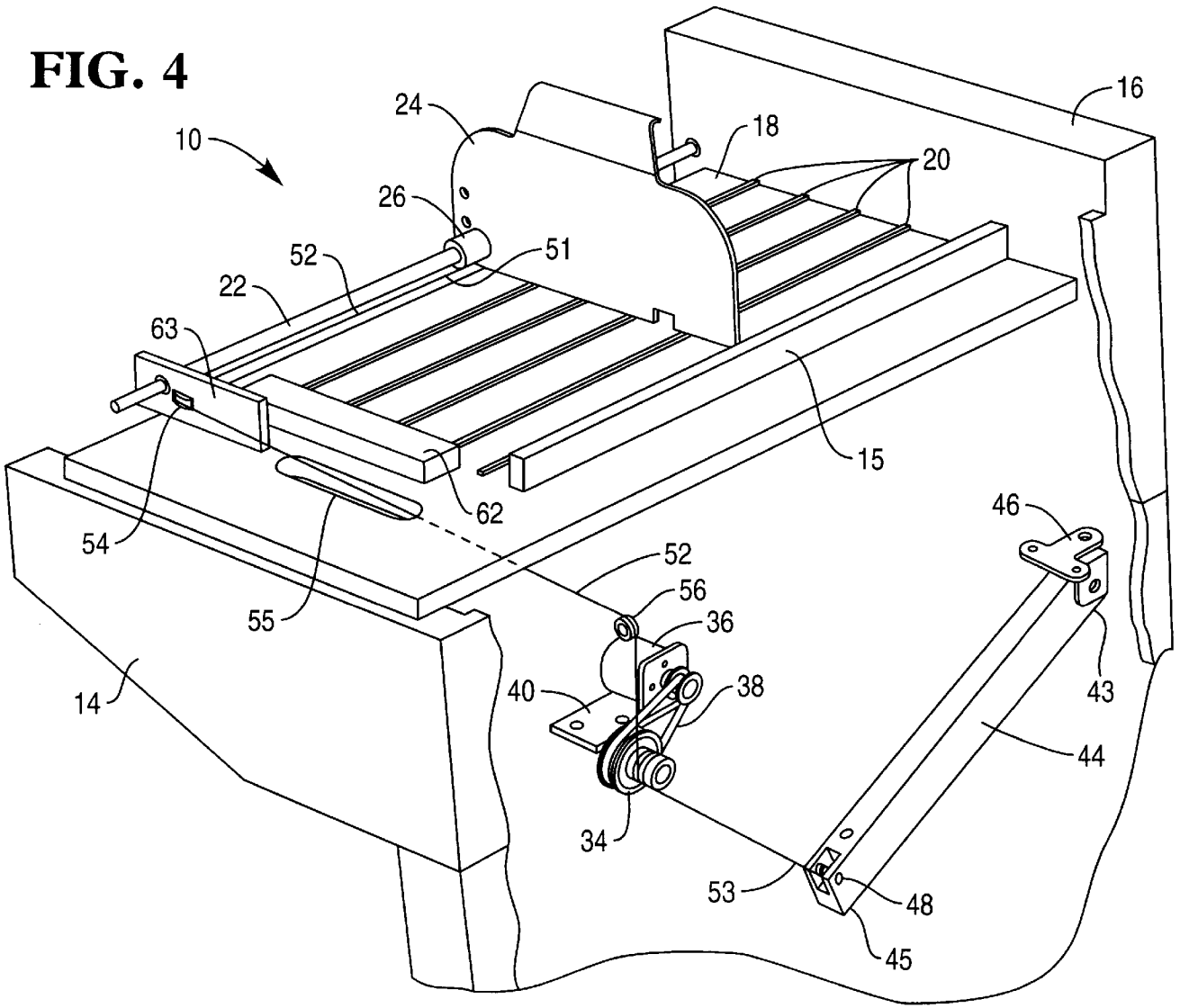
FIG. 4 is a view similar to FIG. 1 and showing certain parts broken away.
Figure 13:
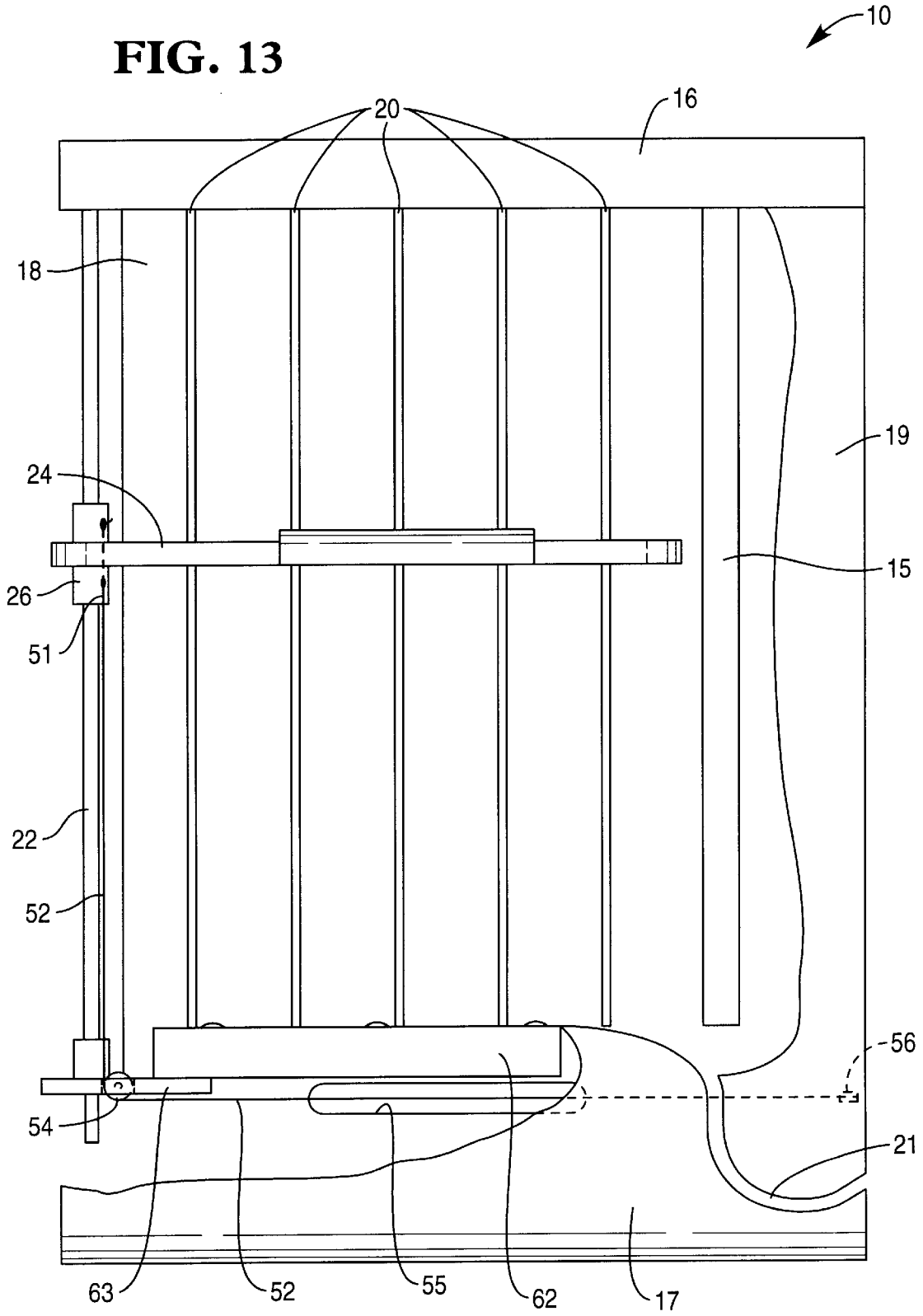
FIG. 13 is a view looking in the direction of arrow A in FIG. 1.

The present invention is directed to a document feeder tray for use in a document processing system. The specific use and construction of the present invention may vary. By way of example as shown in FIGS. 1, 4, and 13, a document feeder tray constructed in accordance with the present invention is embodied in a check processing system 10.

The check processing system 10 includes a side housing wall 12 interconnecting first and second end housing walls 14, 16. A bottom wall 18 is connected between the first and second end housing walls 14, 16. An interior wall 15 is mounted on the bottom wall 18 and extends parallel to the side housing wall 12. A document feeding mechanism 62 is located in the vicinity of the first end housing wall 14. A first cover piece 17 is disposed on the first end wall 14 and a second cover piece 19 is disposed on the side housing wall 12. The first and second cover pieces 17, 19 define a somewhat S-shaped groove 21 therebetween in the vicinity of the document feeding mechanism 62.

A plurality of metal rails 20 are disposed on the bottom wall 18. The metal rails 20 extend parallel with each other between the second end housing wall 16 and the document feeding mechanism 62. A straight metal shaft 22 lies opposite the side housing wall 12 and is connected between the second end housing wall 16 and an end stop plate 63 located in the vicinity of the document feeding mechanism 62. The shaft 22 extends parallel with the rails 20. The second end housing wall 16, the side housing wall 12, the shaft 22 and the document feeding mechanism 62 define a document stacking area in which documents to be processed can be placed.

Figure 2:
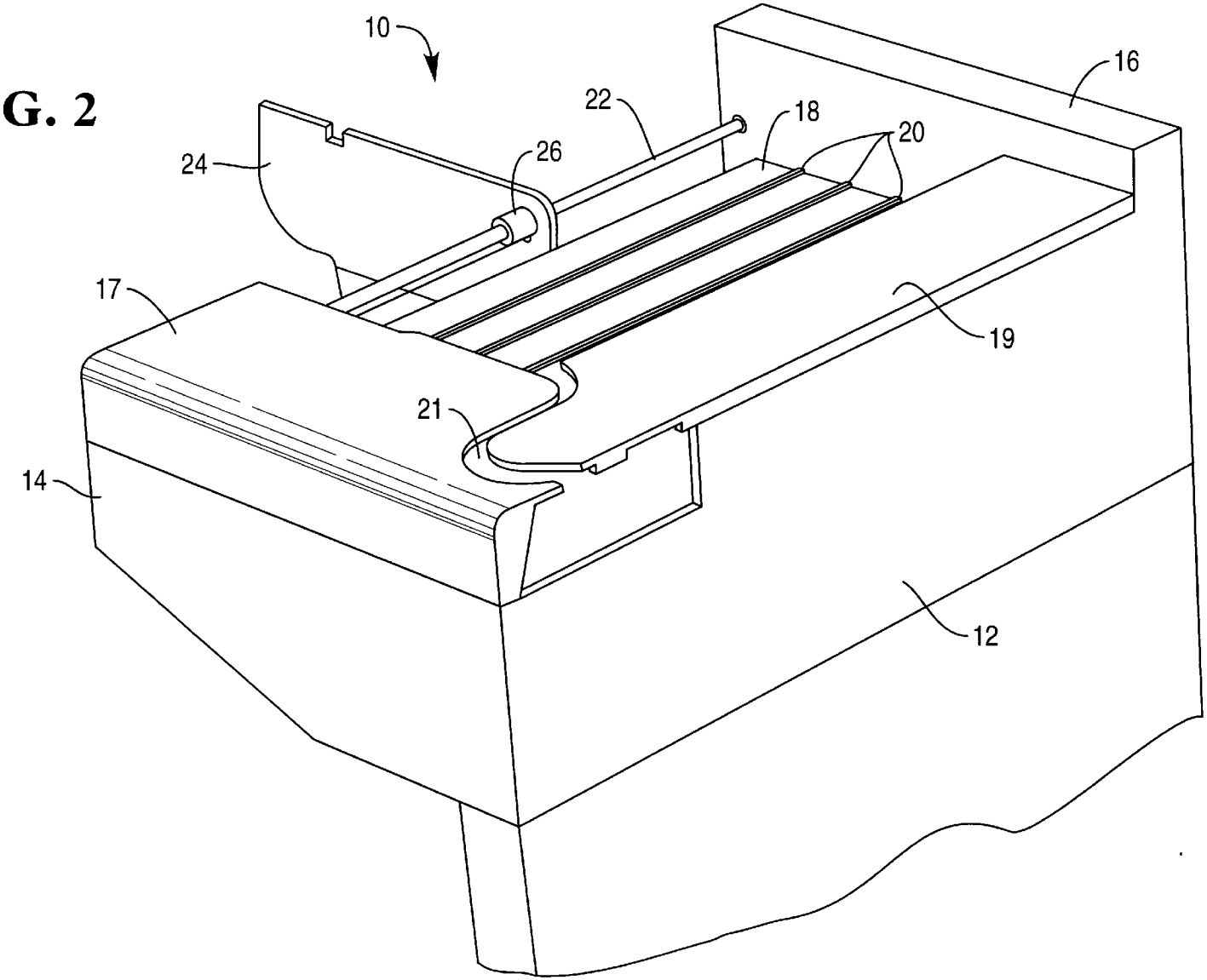
FIGS. 2 and 3 are views similar to FIG. 2 and showing parts in different positions.
Figure 3:
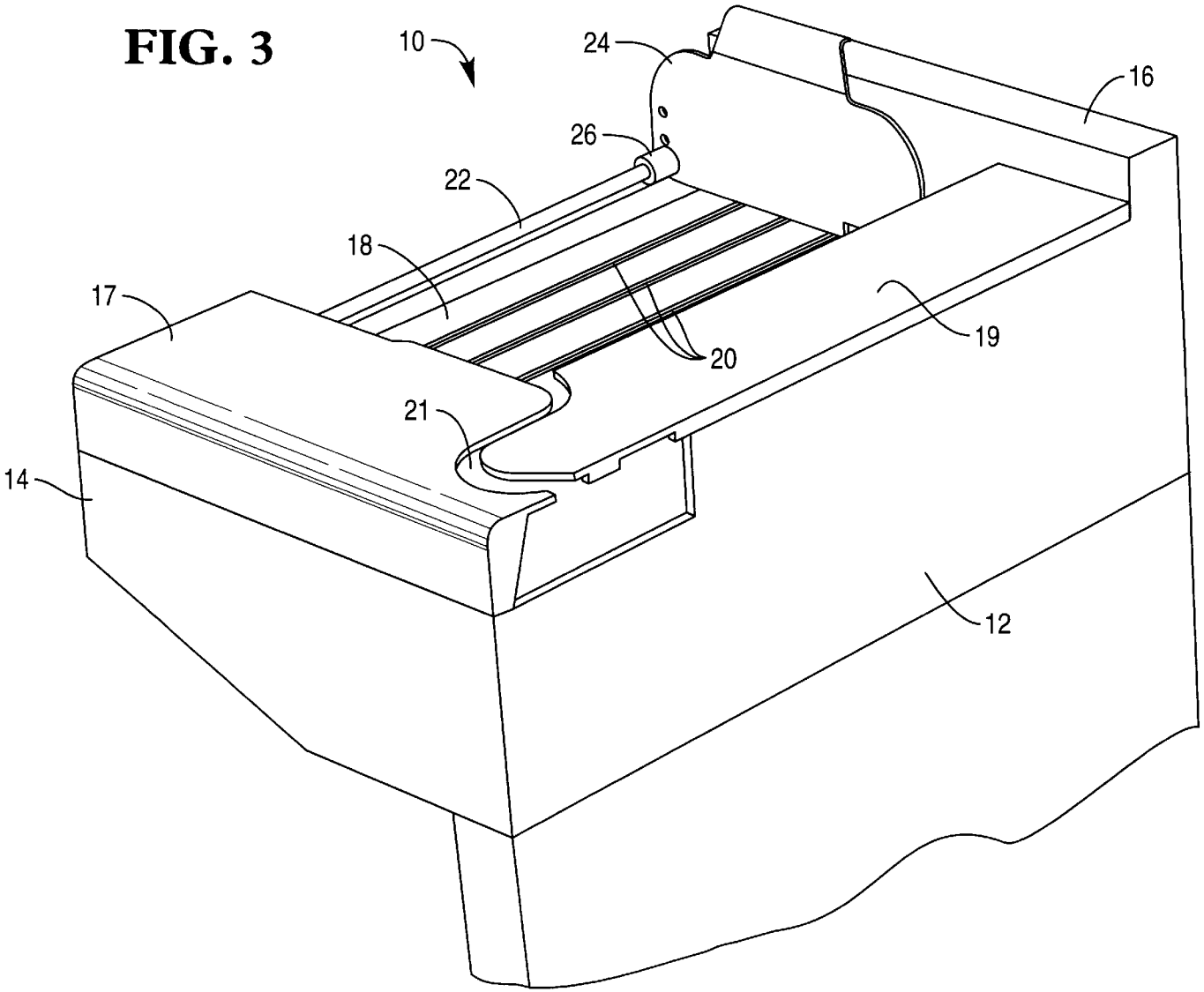

A paddle 24 is supported by linear ball bushings 26 on the shaft 22. The bushings 26 support the paddle 24 for rotation about the longitudinal central axis of the shaft 22, such as between the position of the paddle shown in FIG. 1 and the position of the paddle shown in FIG. 2. The bushings 26 also support the paddle 24 for sliding movement back and forth along the longitudinal extent of the shaft 22, such as between the position of the paddle shown in FIG. 1 and the position of the paddle shown in FIG. 3. The movement of the paddle 24 along the longitudinal extent of the shaft 22 is limited by the second end housing wall 16 and the document feeding mechanism 62.

Figure 12:
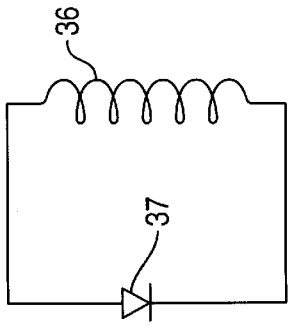
FIG. 12 is a schematic view of a circuit used in the document tray of FIG. 1.

As shown in FIG. 4, a capstan 34 and a DC motor 36 are located in a space beneath the bottom wall 18 and adjacent the side housing wall 12. The capstan 34 and the motor 36 are fixedly attached to a mounting plate 40 which, in turn, is fixedly attached to a frame part of the check processing system 10. An endless drive belt 38 drivingly interconnects the capstan 34 and the DC motor 36. As schematically shown in FIG. 12, the stator of the DC motor 36 is shorted to itself through a diode 37.

Figure 5:
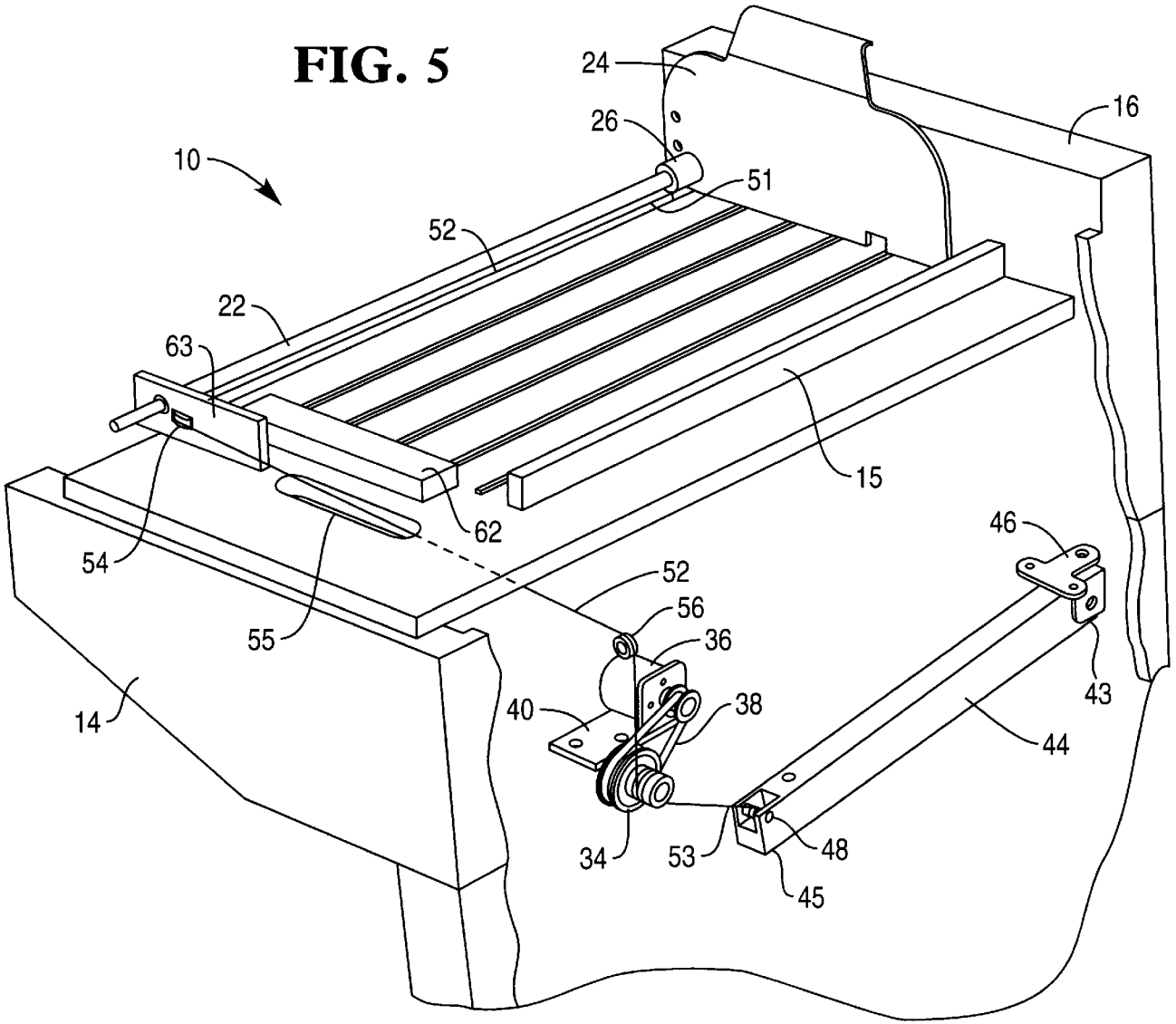
FIGS. 5–7 are views similar to FIG. 4 and showing parts in different positions.

A longitudinally extending member 44 has opposite ends 43, 45, as shown in FIG. 4. The one end 43 of the member 44 is pivotably attached to a mounting plate 46 which, in turn, is fixedly attached to a frame part of the check processing system 10. A connection rod 48 is disposed at the other end 45 of the member 44. The mounting plate 46 enables the member 44 to pivot about its end 43 from the position shown in FIG. 4 to a position such as shown in FIG. 5 or a position such as shown in FIG. 6.

A wire cable 52 has opposite ends 51, 53, as shown in FIG. 4. The one end 51 of the wire cable 52 is fixedly attached to the paddle 24 at a location adjoining the bushing 26. The cable 52 is routed around a pulley 54 located in the vicinity of the document feeding mechanism 62, and then along the document feeding mechanism through an opening 55 in the bottom wall 18 towards another pulley 56 located in the vicinity of the capstan 34 and the motor 36. The cable 52 is routed around the pulley 56, and then wrapped around the capstan 34 in a known manner before the other end 53 of the cable 42 is fixedly attached to the connection rod 48 at the end 45 of the member 44.

Figure 6:
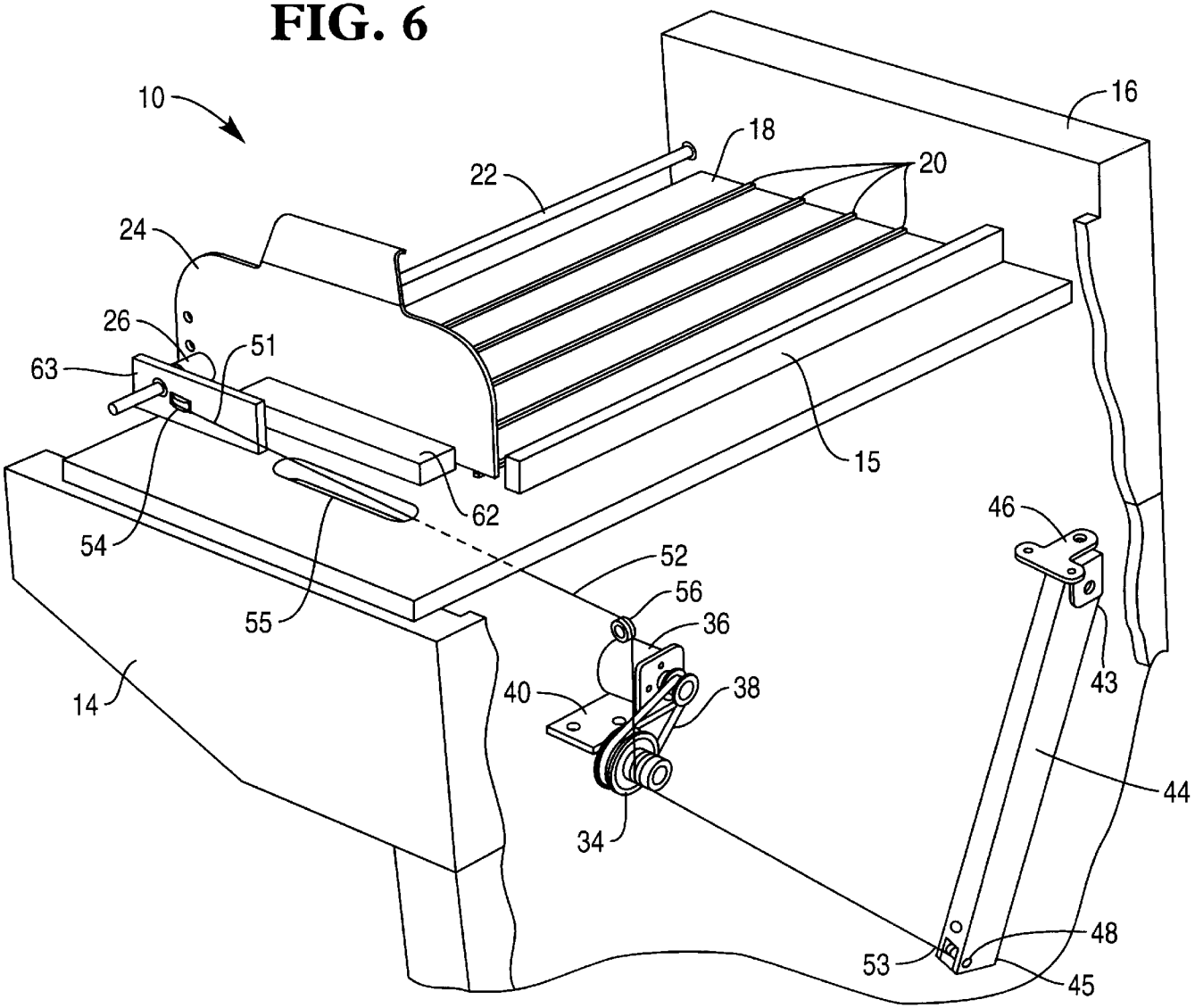
Figure 7:
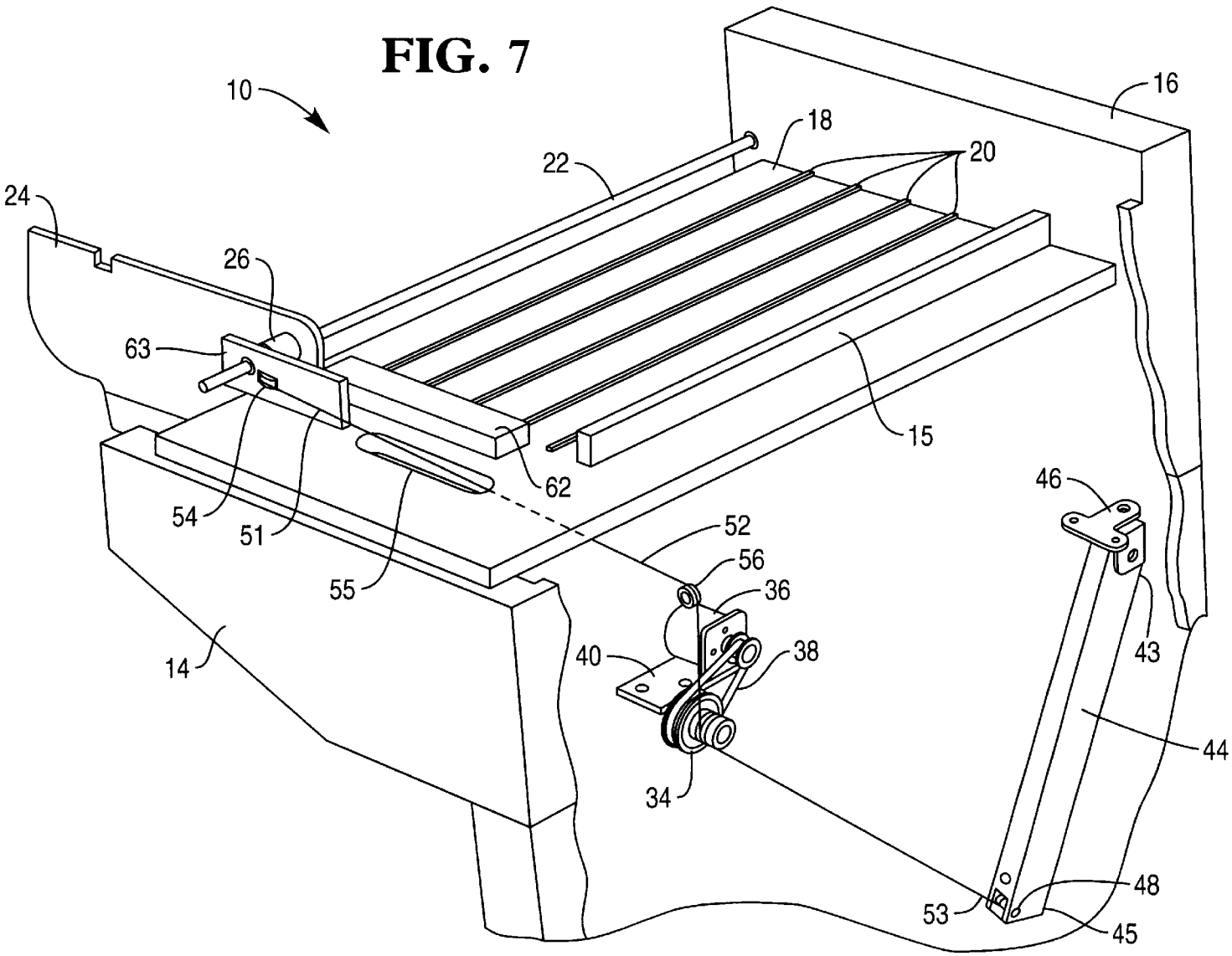
Figure 8:
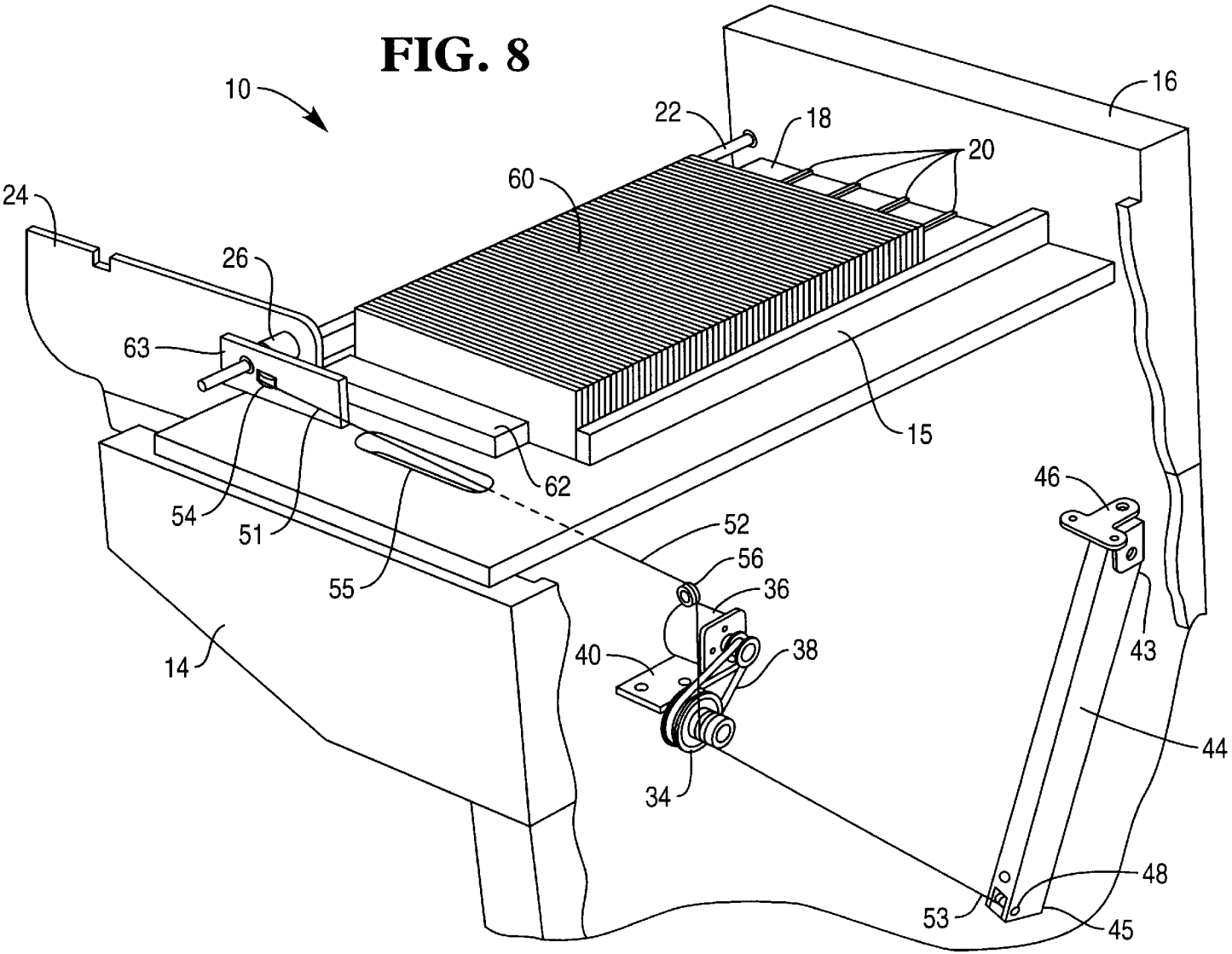
FIG. 8 is a view of the document feeder tray of FIG. 7 and containing a stack of documents.
Figure 9:
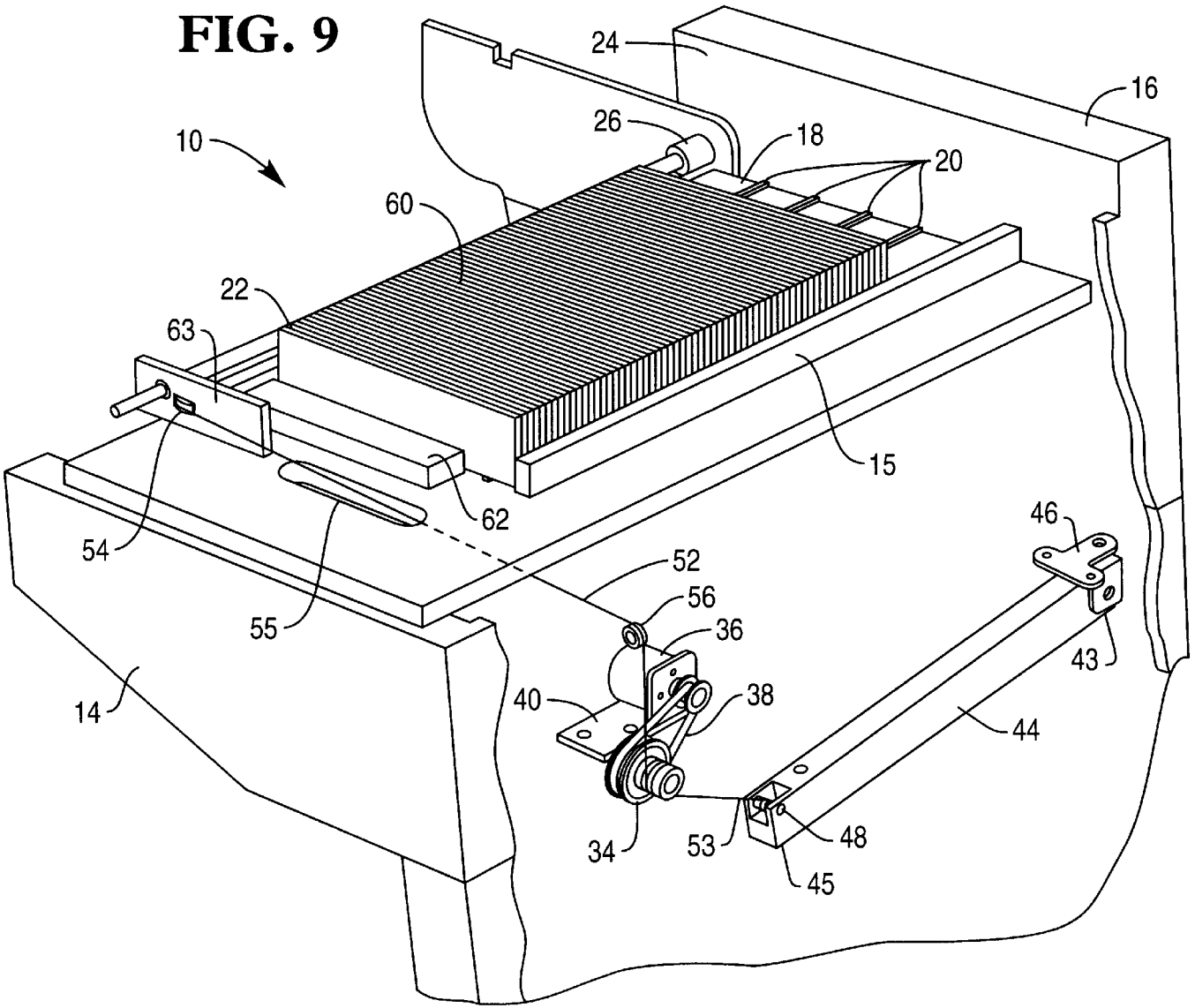
FIGS. 9–11 are views similar to FIG. 8 and showing parts in different positions.

To load a stack of documents into an empty document stacking area as shown in FIG. 6, the paddle 24 is first pivoted about the shaft 22 from the position shown in FIG. 6 to the position shown in FIG. 7. A stack 60 of documents is then placed into the document stacking area as shown in FIG. 8. The paddle 24 is then moved linearly along the shaft 22 from the position shown in FIG. 8 to the position shown in FIG. 9. The paddle 24 is then pivoted about the shaft 22 from the position shown in FIG. 9 to the position shown in FIG. 10 and released.

Figure 10:
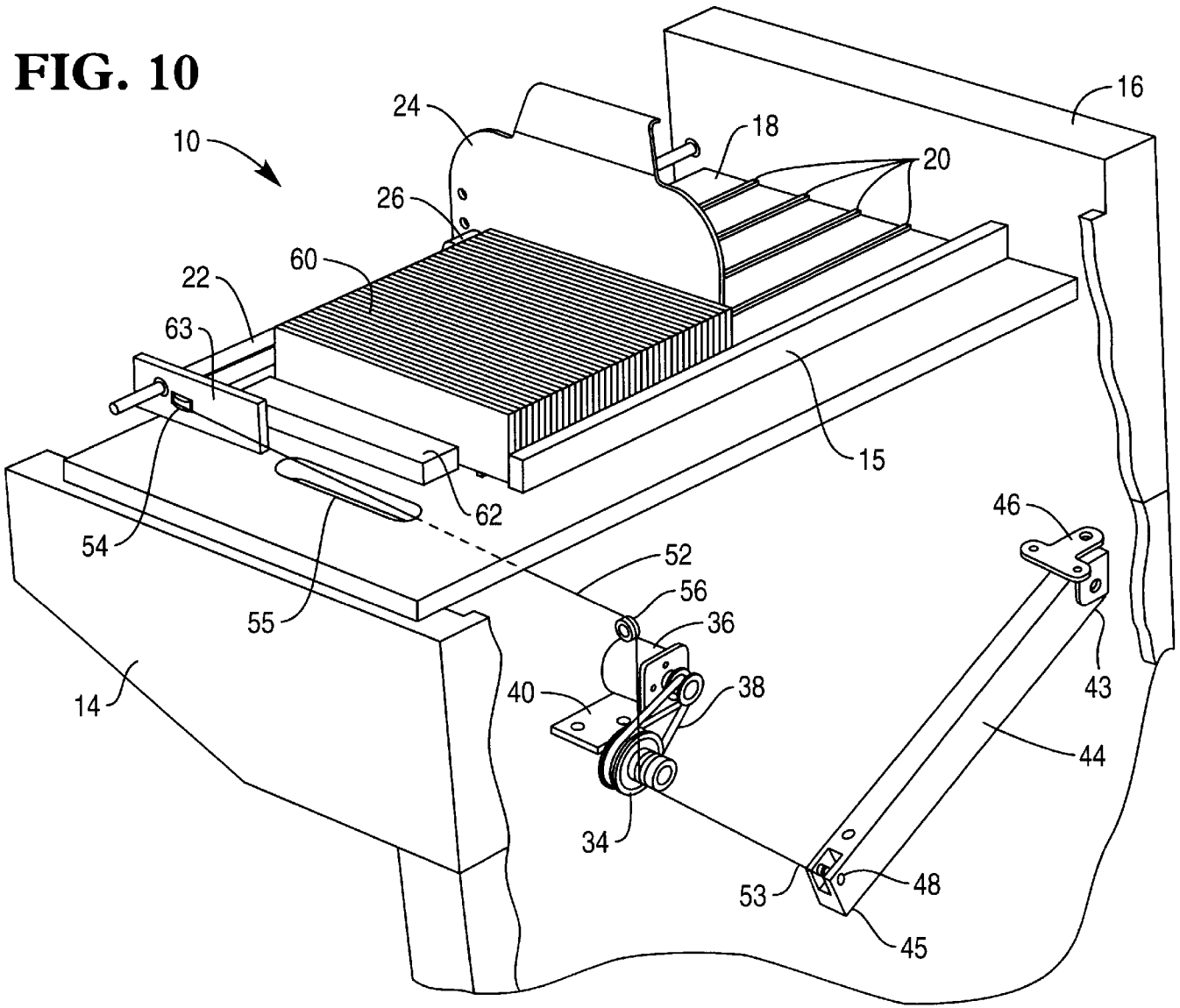

When the paddle 24 is released in the position shown in FIG. 10, the member 44 is in a near horizontal position. When the member 44 is in the near horizontal position shown in FIG. 10, a maximum amount of force is acting on the cable 52 in a direction which pulls the paddle 24 towards the stack 60. Accordingly, when the paddle 24 is released in the position shown in FIG. 10, the paddle 24 pushes the stack 60 towards the document feeding mechanism 62.

The document feeding mechanism 62 operates in a known manner to feed documents one-by-one from the stack 60 of documents along a document feed path which coincides with the shape of the S-shaped groove 21 defined between the first and second top pieces 17, 19. Numerous document feeding mechanisms are readily available in the commercial marketplace. Their structure and operation are known and, therefore, will not be described herein.

While the document feeding mechanism 62 is feeding documents one-by-one from the stack 60, the remaining documents in the stack are advanced towards the document feeding mechanism due to the weight of the member 44 acting on the paddle 24 as described hereinabove. As the paddle 24 is advancing the remaining documents in the stack 60 towards the document feeding mechanism 62 from the position shown in FIG. 10 to the position shown in FIG. 11, the member 44 moves from the near horizontal position shown in FIG. 10 to the near vertical position shown in FIG. 11.

Figure 11:
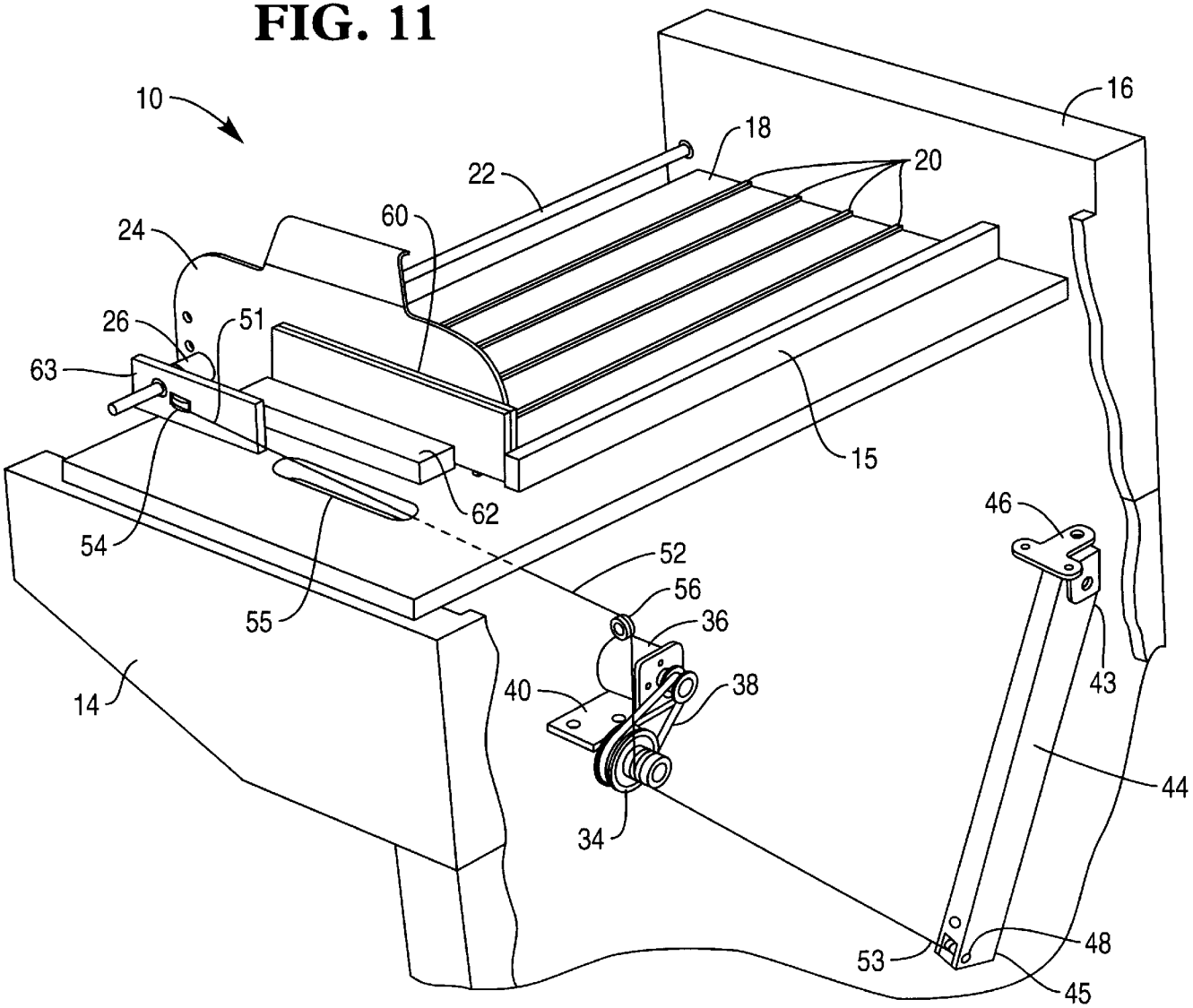
Figure 14:
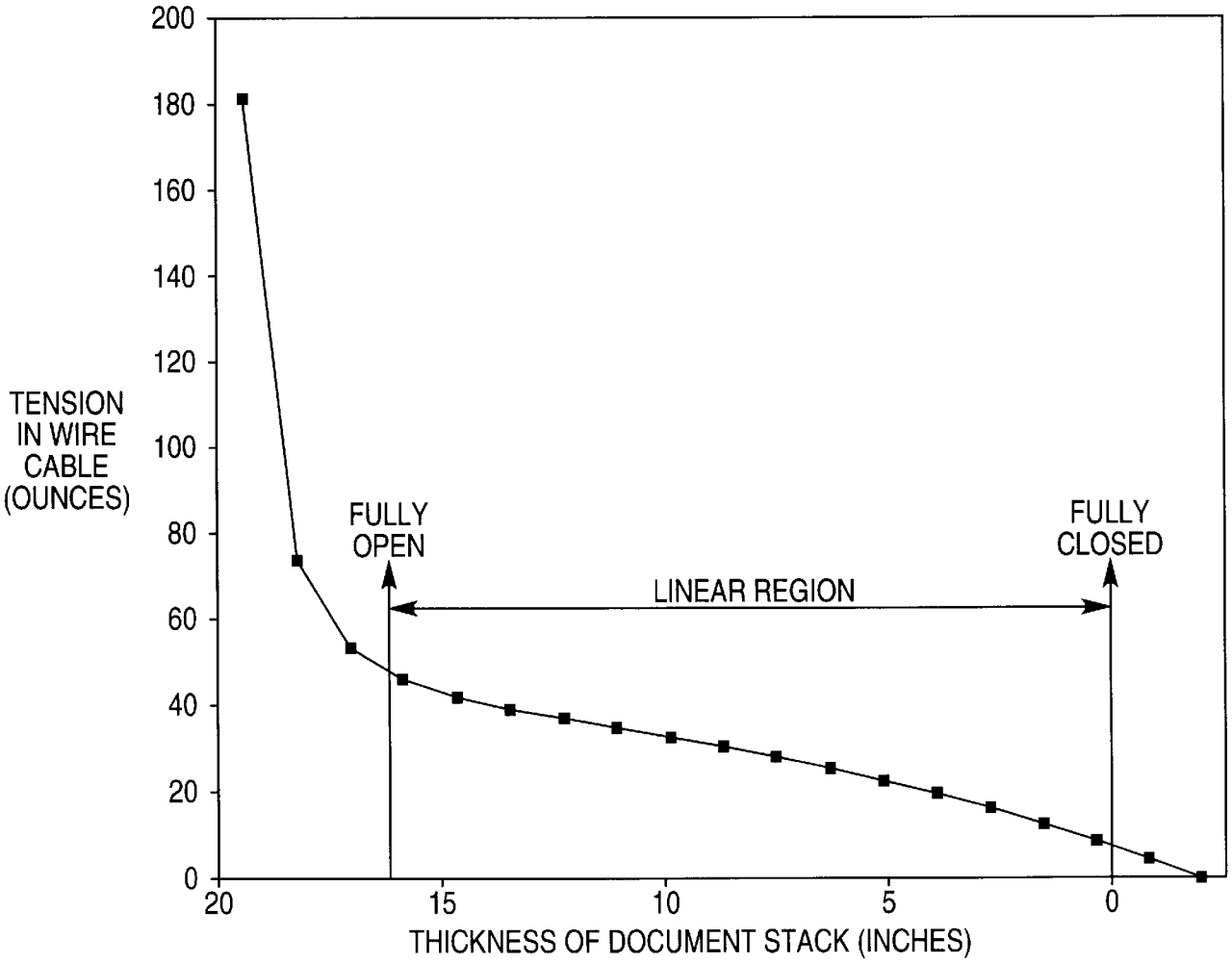
FIG. 14 is a graph illustrating the relationship between two variable quantities in the document processing system of FIG. 1.

As the member 44 moves from the near horizontal position shown in FIG. 10 towards the near vertical position shown in FIG. 11, the force acting on the wire cable 52 and, thus, the paddle 24 changes. As depicted in the graph of FIG. 14, the force acting on the wire cable 52 initially changes exponentially when the member 44 is in the near horizontal position shown in FIG. 10, and then changes linearly as the member 44 continues to move toward the near vertical position shown in FIG. 11. The member 44 is connected to the paddle 24 in such a way that the member 44 is movable only within the near linear portion of the graph of FIG. 14. The movement of the member 44 from the near horizontal position shown in FIG. 10 towards and the near vertical position shown in FIG. 11 as the stack 60 is being advanced towards the document feeding mechanism 62 results in a linearly decreasing force acting on the paddle 24. Accordingly, the paddle 24 pushes the stack 60 with a relatively greater force when the stack is relatively larger such as shown in FIG. 10, and with a relatively lesser force when the stack is relatively smaller such as shown in FIG. 11.

The DC motor 36 and the capstan 34 cooperate to limit the speed at which the paddle 24 can be moved from an open position such as shown in FIG. 10 to a closed position such as shown in FIG. 11. The speed at which the paddle 24 can be moved is limited because electricity generated by the motor 36 is fed back to itself via the diode 37 (FIG. 12) to create a braking effect. The diode 37 allows the paddle 24 to be easily moved without braking effect from the closed position such as shown in FIG. 11 to the open position such as shown in FIG. 10.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document processing system comprising:

a frame part;

a document feeding mechanism;

surface means defining a horizontal surface on which a stack of documents to be fed to the document feeding mechanism can be placed;

a plate movable relative to the horizontal surface and for advancing the stack of documents along the horizontal surface towards the document feeding mechanism as the plate moves relative to the horizontal surface;

a body having a center of mass which is movable between first and second positions relative to the frame part; and means coupling the body and the plate for enabling (i) weight of the body at the center of mass to provide a first predetermined amount of force which acts on the plate to advance the stack of documents along the horizontal surface towards the document feeding mechanism when the center of mass of the body is at the first position relative to the frame part, and (ii) weight of the body at the center of mass to provide a second predetermined amount of force which is different from the first predetermined amount of force and which acts on the plate to advance the stack of documents along the horizontal surface towards the document feeding mechanism when the center of mass of the body is at the second position relative to the frame part.

2. A document processing system according to claim 1, wherein the body includes a longitudinally extending member having a first end portion which is a free end and a second end portion which is pivotably connected to the frame part such that the center of mass of the body moves between the first and second positions relative to the frame part when the longitudinally extending member pivots about the second end portion.

3. A document processing system according to claim 2, wherein the coupling means includes a cable having one end thereof connected to the plate and the other end thereof connected to the first end portion of the longitudinally extending member to allow the first predetermined amount of force to act on the plate to advance the stack of documents along the horizontal surface towards the document feeding mechanism when the center of mass of the body is at the first position relative to the frame part, and to allow the second predetermined amount of force to act on the plate to advance the stack of documents along the horizontal surface towards the document feeding mechanism when the center of mass of the body is at the second position relative to the frame part.

4. A document processing system according to claim 3, wherein the coupling means includes a DC motor and a capstan drivingly connected to the DC motor and around which the cable is wrapped.

5. A document processing system according to claim 4, wherein the coupling means includes a diode connected to the DC motor such that the DC motor is shorted to itself to provide a braking effect when the plate is moving along the horizontal surface towards the document feeding mechanism at a speed greater than a predetermined speed.

6. A document processing system comprising:

a frame part;

a document feeding mechanism;

surface means defining a horizontal surface on which a stack of documents to be fed to the document feeding mechanism can be placed;

a plate movable relative to the horizontal surface and for advancing the stack of documents along the horizontal surface towards the document feeding mechanism as the plate moves relative to the horizontal surface;

a body having a center of mass which is movable between first and second positions relative to the frame part; and an interconnecting mechanism coupling the body and the plate such that (i) weight of the body at the center of mass provides a first predetermined amount of force which acts on the plate to advance the stack of documents along the horizontal surface towards the document feeding mechanism when the center of mass of the body is at the first position relative to the frame part, and (ii) weight of the body at the center of mass provides a second predetermined amount of force which is different from the first predetermined amount of force and which acts on the plate to advance the stack of documents along the horizontal surface towards the document feeding mechanism when the center of mass of the body is at the second position relative to the frame part.

* * * * *